United States Patent [19]

Hoebing

[11] 4,099,754

[45] Jul. 11, 1978

[54] DOOR SECURITY GUARD

[76] Inventor: Robert J. Hoebing, RR 3, Quincy, Ill. 62301

[21] Appl. No.: 813,936

[22] Filed: Jul. 8, 1977

[51] Int. Cl.[2] ..... E05C 5/04

[52] U.S. Cl. ..... 292/206; 292/251; 292/DIG. 65

[58] Field of Search ..... 292/202, 206, 251, 100, 292/58, DIG. 65

[56] References Cited

U.S. PATENT DOCUMENTS

| | | | |
|---|---|---|---|
| 593,598 | 11/1897 | Mills | 292/251 |
| 1,446,364 | 2/1923 | Wheeler | 292/206 X |
| 3,510,162 | 5/1970 | Smith et al. | 292/100 X |

*Primary Examiner*—Richard E. Moore

*Attorney, Agent, or Firm*—Hill, Gross, Simpson, Van Santen, Steadman, Chiara & Simpson

[57] ABSTRACT

A door security latch is disclosed including a link member pivotably attached to the door frame on the inside of the door and which is swingable to a position overlapping the inside face of the door. The link carries a threaded stop having a door face engageable portion which can be screwed into abutment with the door face.

2 Claims, 7 Drawing Figures

DOOR SECURITY GUARD

BACKGROUND OF THE INVENTION

1. Field of the Invention

This invention relates to security devices and more particularly to a mechanical door latch.

2. Prior Art

Door securing devices commonly in use include locks, slide bolts, slide chains, and the like. Although locks, particularly of the bolt action type, provide a measure of security, they are ineffective in any public use areas such as hotels and motels where the establishment must have a master key. The mere existence of a master key, or duplicate keys, creates the possibly of a copy of the copy falling into inappropriate hands.

Slide bolts, as presently used, do not provide a significant measure of protection, first, because they are generally relatively flimsy, second, because they are screwed into the door which does not provide a firm base and third, because over the years they will become misaligned and become difficult or impossible to activate. Further, their use is not favored in public use buildings such as hotels and motels because they may be difficult to operate thereby providing a fire hazard and because such establishments must allow for the possibility of emergency entry into the locked room from the outside without major damage. Chain locks provide more of a psychological than a physical deterent. Anybody having access to a master or duplicate key will find a chain lock to present no barrier since, even if it cannot be worked from the exterior with the door partially opened, it can easily and quietly be cut.

In view of the above restrictions with known devices it has been suggested, in the past, to use other forms of hinged or swinging latch devices having a portion affixed to the door frame and a swing or slide portion extendable into an overlapping relationship with the door. These devices have generally required engagement with a door carried member thereby relying in part upon the strength of the anchor to the door while further having the same misalignment problems discussed above in connection with slide bolts. Additionally provision has not been made in such prior devices for intentional disassembly from the outside when necessary.

It would therefore be an advance in the art to provide an improved security latch which is not dependent upon the strength of any mounting portion attached to the door, which is easily and quickly actutable, which does not require alignment of co-fitting parts and which, if necessary, can be deactivated from exterior of the locked room by methods which are not easily surreptitiously carried out.

SUMMARY OF THE INVENTION

My invention provides an improved security latch which, in its simplest embodiment consists of a lag bolt or screw firmly anchored in the timbers of the door frame and having a projection interior of the room to which a pivotable link is attached. Abutting stops between the link and a non-pivotable door frame attached portion limit the swing of the link between a disengaged and an engaged position. The link carries, on its free end, a threaded abutment member in opposition to the door. A handle on the room interior side of the link allows the door abutment end of the threaded portion to be urged into presing engagement with the inside face of the door. Thus, the door can be secured against its jam in a closed position in a manner which is mechanically stable. Release of the door requires only rotation of the handle to bring the abutment end out of engagement with the door and thereafter a swinging of the link to the non-latched position. Because this requires a rotating movement in rotating the handle, it cannot practically be accomplished from exterior of the room. Further, since the handle overlies the door on the interior, it is not accessible from exterior of the room.

The use of a threaded abutment member allows a single latch assembly to be manufactured for use in connection with the wide variety of door frames and doors including both flush fitting and interior projecting doors. By anchoring the lag screw deeply into the frame of the door, and by providing a strong link, a practically burglar proof latch system is provided.

For use in public places, such as motels and hotels, the lag screw can be substituted by a lag bolt which extends through the door frame and is accessible from the exterior of the room by removing a molding member providing access to nut or by disassemblying a cap member to provide access to a slotted end of the bolt. In this manner, emergency access to the room can be had while requiring external disassembly which cannot easily be carried out in a public space without notice.

In a further embodiment, the threaded abutment member and handle may be equipped with a light source which is activated automatically when the latch is engaged so that the handle can be quickly and conveniently located in the dark in case an emergency exit from the room becomes necessary.

It is therefore an object of this invention to provide an improved door security latch.

It is another and more particular object of this invention to provide a door security latch which utilizes a pivotable member attached to the door frame including a link extending to a position overlyng the inside face of the door, the link equipped with a threaded abutment member which can be brought into abutting engagement with the inside face of the door.

It is another, and particular, object of the invention to provide a door security latch having an inside pivotable link member attached to the door frame through a lag bolt with means exterior of the room closed by the door allowing disassembly of the latch but requiring disassembly of an external piece necessitating use of obvious tools.

It is another object of this invention to provide a door security latch system having a pivotable member affixed to the frame of the door pivotable to a door overlapping position with an abutment member movable into abutment with an inside face of the door when the pivotable member is pivoted to a door overlapping position, the abutment member including a handle, the handle having an internal light source activated by activation of the latch system.

Other objects, features and advantages of the invention will be readily apparent from the following description of a preferred embodiment thereof, taken in conjunction with the accompanying drawings, although variations and modifications may be effected without departing from th spirit and scope of the novel concepts of the disclosure, and in which:

DESCRIPTION OF THE PREFERRED EMBODIMENTS

Figure 1:
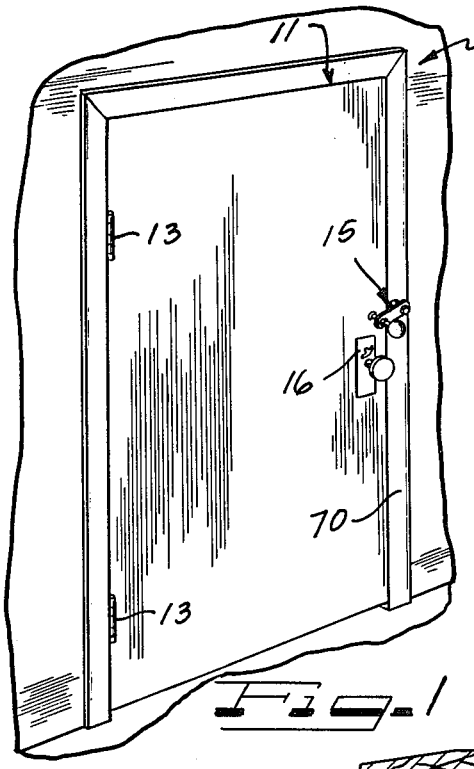
FIG. 1 is a perspective view of a door and doorway equipped with the latch device of this invention.
Figure 2:
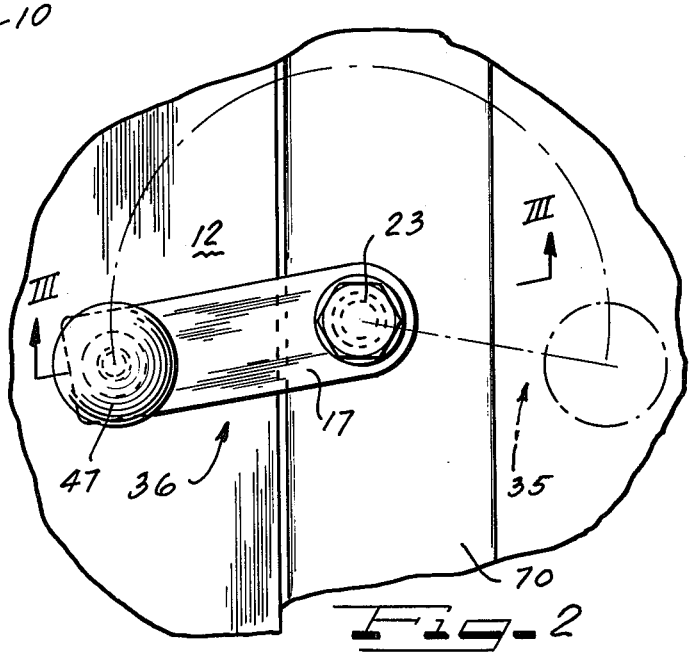
FIG. 2 is a fragmentary plan view of the door frame and a portion of the door of FIG. 1 illustrating movement of the latch system between engaged and disengaged positions.

FIG. 1 illustrates a doorway 10 including a framed door opening 11 closed by a door 12 attached to the frame by means of hinges 13. A security latch system 15 according to this invention is provided in addition to the normal door locks 16.

Figure 3:
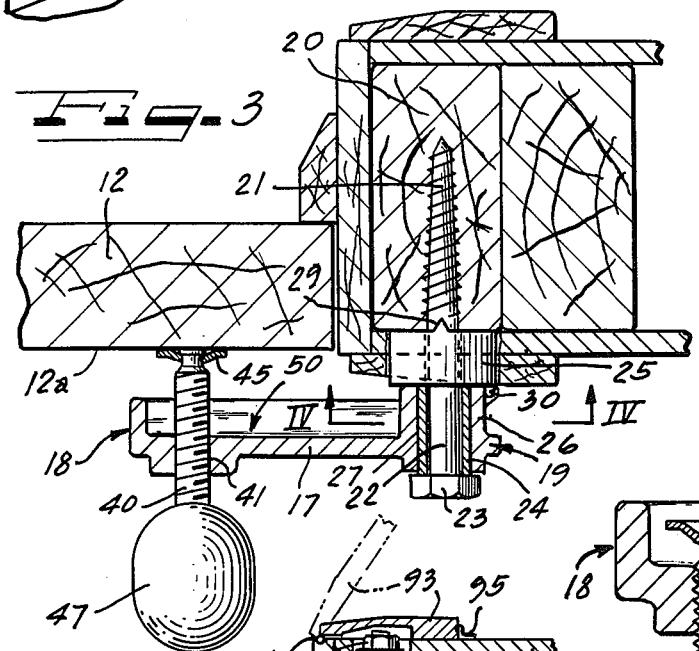
FIG. 3 is a fragmentary cross-sectional view taken along the lines III—III of FIG. 2.
Figure 4:
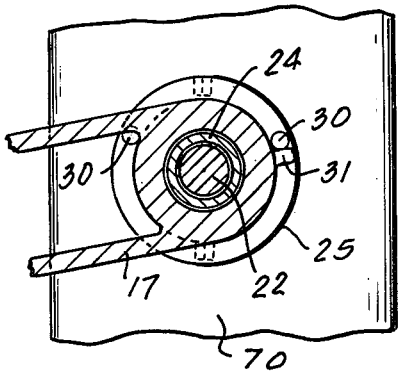
FIG. 4 is a fragmentary cross-sectional view taken along the lines IV—IV of FIG. 3.

As best illustrated in FIG. 3, the security latch system includes a link member 17 having a free end 18 and an attachment end 19. The attachment end is attached to the door frame timbers 20 by means of a lag screw 21 having a projecting shaft 22 capped by a head 23. The attachment end 19 of the link 17 has a boss 26 with a bore 27 therethrough which receives the shaft projection 22. A sleeve 24 may be imposed between the boss bore and the shaft. A collar portion 25 extends between the frame timber 20 and the boss 26 and includes antirotation pins 29 embedded in the timber 20. The collar has spaced apart projections 30 which cooperate with a lug 31 on the boss to limit rotation of the link on the lag screw between a disengaged position 35 where the link fully overlies the building wall and an engaged position 36 where the link has its free end 18 overlying the door 12.

The free end of the link is equipped with a threaded member 40 having an abutment end 45 which is movable into engagement with the inside face **12*a* of the door 12 upon rotation of the threaded member. A handle 47 on the other side of the link 16 provides for rotation of the threaded member. If desired, a quick advance thread may be used between the threaded member and the threaded bore 41 of the free end 18 of the link so that minimal rotation of the handle 47 is necessary to advance the abutment end 45 into engagement with the door. Although a bulb handle 47** is illustrated, it is to be understood that other shapes could be relied upon.

Preferably the link has a door facing recess 50 into which the abutment end 45 can be withdrawn so that the abutment end will clear the door molding 70 when being swung between the positions 35 and 36.

Figure 5:
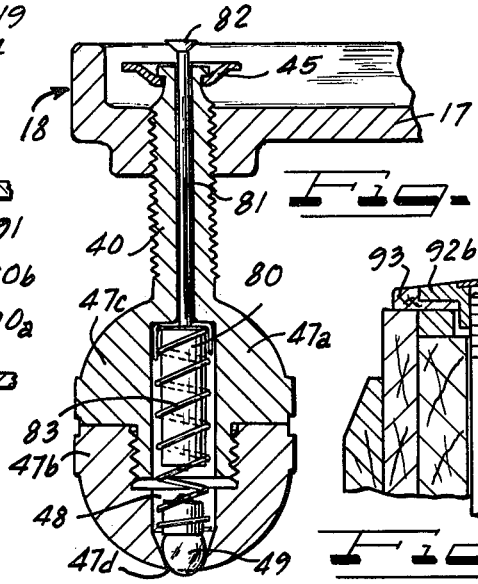
FIG. 5 is an enlarged fragmentary cross-sectional view of the abutment end portion of the latch of this invention illustrating an embodiment equipped with a light source.

In order to provide quick location of the security latch handle 47 in the dark, FIG. 5 illustrates a modification having a handle **47*a* constructed of threaded together pieces 47*b* and 47*c* both of which define a light receiving cavity 48 having a light 49 projecting from an opening 47*d* in the portion 47*b*. A power source 80 is positioned within the cavity and is urged by a push rod 81 into engagement with the bulb 49 to activate the same. The push rod 81 extends through the threaded portion 40 and terminates in a tip 82 exterior of the abutment end 45 whereby the tip 82 will engage the door face 12*a* upon activation of the latch urging the power source 80 against spring 83 into contact with the light 49**.

Although a battery light source is herein disclosed, it is to be understood that other methods of activating the light, including a built-in electric source, are contemplated. It is, however, preferable that the light be activated by engagement between the abutment face 45 and the door surface **12*a*** so that the light will only be activated when the latch system is engaged. This both provides for location and provides an indication that the latch system has been effectively contacted with the door.

Figure 6:
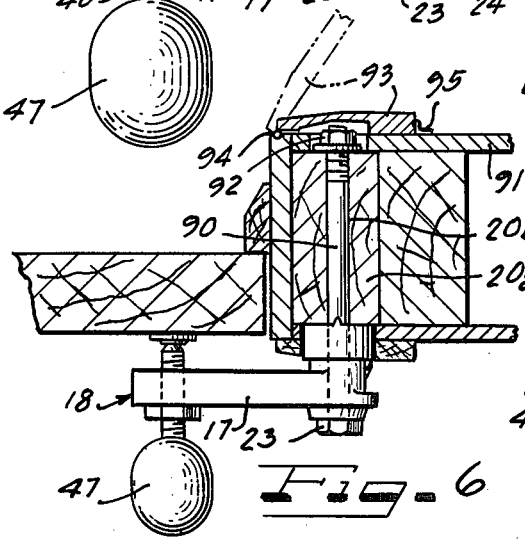
FIG. 6 is a fragmentary cross-sectional view similar to FIG. 3 illustrating a modified form of the invention.
Figure 7:
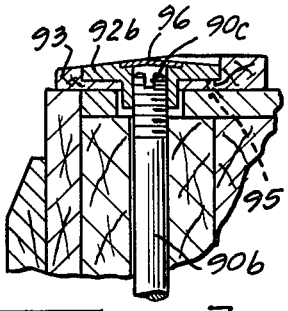
FIG. 7 is a fragmentary cross-sectional view of the outside end of a modified lag bolt assembly for this invention.

The above-described embodiment is particularly suitable for home use, private apartments or the like. FIGS. 6 and 7 illustrate modifications which are principally adapted for use in public facilities where the management may require an emergency means to deactivate the latch from the exterior without substantially harming the building. In the embodiments of FIGS. 6 and 7 the timber **20*a* is provided with a bore therethrough 20*b* and the lag screw 21 is changed to a lag bolt 90 which extends all the way through the timber 20*a* to the outside wall 91 of the room. The lag bolt can be capped with a standard nut and washer 92 which are buried behind the exterior door molding 93. Preferably the nut 92 will be located in a recess in the wall 91 so that it can be rotated only by means of a socket wrench. Additionally of course the nut may have a non-standard design requiring a special tool, not generally available to the public. If desired the molding 93 may be hinged as at 94 having a snap latch as at 95** to retain it in a closed position. Alternatively, the molding can be, as is common, semi-permanently attached to the wall by nails.

Thus, the embodiment of FIG. 6 can have the latch system disengaged by prying open the molding 93 and thereafter unscrewing the nut 92 by use of obvious tools which cannot easily be operated in secrecy in a public way such as the corridor of a hotel. The bolt can then be pushed through the hole **20*b*** to drop the latch from the inside wall.

FIG. 7 illustrates a second embodiment of an outside disengageable latch. The lag bolt **90*b* is equipped with a tool receiving tip 90*c* which may require a screwdriver or the like for rotation. The nut 92*b* which maintains the bolt in position in the door frame is recessed into the molding 93*b* in a manner which prevents rotation of the nut 92, as by means of location fixing pins 95. The nut is closed by a cap member 96 which must be removed to gain access to the end of the bolt. The cap member 96, may for example, be soldered into the nut requiring application of high heat to remove it. Alternatively the cap 96 may be otherwise affixed to the nut in such a manner as to require the use of special tools for removal. Once the nut cap 96** is removed, the bolt can be rotated to disengage the nut allowing the bolt to then be passed through the bolt opening. Upon reassembly a few nut will have to be provided.

It can therefor be seen from the above that my invention provides an improved door security latch which includes a pivotable link member attached to the door frame and swingable between a position where no portion of the link overlies the door opening to a position where a free end of the link overlies the door opening. The free end is equipped with a door inside face abutment which can be threaded into pressed engagement with the door face. By tightening the threaded member, a mechanically secure latch is provided which cannot be overcome from exterior the door.

In various embodiments I have illustrated a rotation limiting means which maintains the latch, when in the engaged position, in an overcenter rotational angle position in such a manner that a link cannot drop out of the latched position. In other embodiments I have illustrated a light means illuminating the latch sytem when it is engaged. In yet other embodiments I have shown a latch system which can be intentionally disengaged from outside of the secured room but which disengagement requires the use of obvious tool and which may further require disassembly of either portions of the building construction or difficult to disassemble portions of the latch system.

Although the teachings of my invention have herein been discussed with reference to specific theories and embodiments, it is to be understood that these are by way of illustration only and that others may wish to utilize my invention in different designs or application.

I claim as my invention:

1. A door security latch comprising an attachment member for attachment of the latch to a door frame adjacent a door opening having a projecting portion adapted to project beyond the door frame, a link member having a free end and an attachment end, the attachment end pivotably attached to the projecting portion with the link pivotable in a plane substantially normal to the plane of projection of the projecting portion, the free end having a threaded connection to a threaded member, the threaded member having a longitudinal axis of projection substantially normal to the plane of pivotability of the link, the threaded member having one end thereof terminating in a door abutment face and a second end thereof, lying on a side of the link opposite the door abutment face terminating in an actuating handle, rotation of the actuating handle causing the abutment face to withdraw towards the link and to advance away from the link, and the link having a length sufficient to place the abutment face in opposition to an inside surface of a door closing said door opening, the handle means having a light carried thereby and means activating said light only when said abutment face is in engagement with said door surface.

2. A door security latch comprising an attachment member for attachment of the latch to a door frame adjacent a door opening having a projecting portion adapted to project beyond the door frame, a door frame having an inside and an outside, the projection lying on the inside of the door frame, a link member having a free end and an attachment end, the attachment end pivotably attached to the projecting portion with the link pivotable in a plane substantially normal to the plane of projection of the projecting portion, the free end having a threaded connection to a threaded member, the threaded member having a longitudinal axis substantially normal to the plane of pivotability of the link, the threaded member having one end thereof terminating in a door abutment face and a second end thereof, lying on a side of the link opposite the door abutment face, terminating in an actuating handle, rotation of the actuating handle causing the abutment face to withdraw towards the link and to advance away from the link, the link having a length sufficient to place the abutment face in opposition to an inside surface of a door closing said door opening, the attachment member extending through the door frame to adjacent an exterior wall surface of a wall in which the door frame is mounted, means engaging an end of the attachment member adjacent the exterior wall preventing withdrawal of the attachment member through to the wall to the interior of the door frame, said means being selectively disengageable to allow the attachment member to be released from said means whereby the attachment member can be freely pushed through the door frame to allow the door to be opened, cover means on the outside wall surface preventing access to the means, and one of the cover means and means engaging being structured requiring use of tools for a disengagement of the means engaging from the attachment member.

* * * * *

UNITED STATES PATENT AND TRADEMARK OFFICE

CERTIFICATE OF CORRECTION

PATENT NO. : 4,099,754

DATED : July 11, 1978

INVENTOR(S) : Robert J. Hoebing

It is certified that error appears in the above-identified patent and that said Letters Patent are hereby corrected as shown below:

Column 1, line 15, for "existence" read --existance--.

Column 1, line 16, for "possibly" read --possibility--.

Column 1, line 51, for "actutable" read --actuatable--.

Column 2, line 1, for "presing" read --pressing--.

Column 2, line 24, for "disassemblying" read --disassembling--.

Column 2, line 67, for "th" read --the--.

Column 4, line 64, for "few" read --new--.

Signed and Sealed this

*Nineteenth* Day of *February 1980*

[SEAL]

*Attest:*

SIDNEY A. DIAMOND

*Attesting Officer*

*Commissioner of Patents and Trademarks*